United States Patent [19]

McNair

[11] Patent Number: 4,595,969

[45] Date of Patent: Jun. 17, 1986

[54] LAMP MOUNTING APPARATUS AND METHOD

[75] Inventor: Rhett McNair, Anaheim, Calif.

[73] Assignee: Scientific Component Systems, Inc., Anaheim, Calif.

[21] Appl. No.: 710,391

[22] Filed: Mar. 11, 1985

Related U.S. Application Data

[63] Continuation-in-part of Ser. No. 645,288, Aug. 29, 1984.

[51] Int. Cl.[4] ..... A47H 1/10; F21S 3/00

[52] U.S. Cl. ..... 362/217; 362/226; 362/285; 362/306; 362/443; 362/382; 248/328; 339/135

[58] Field of Search ..... 362/382, 414, 428, 443, 362/448, 449, 457, 217, 222, 241, 243, 247, 256, 277, 284, 285, 296, 306; 339/135, 104; 248/328, 317

[56] References Cited

U.S. PATENT DOCUMENTS

| | | | |
|---|---|---|---|
| 1,140,498 | 5/1915 | Cassidy | 362/448 |
| 1,386,803 | 8/1921 | Ryder | 362/258 |

FOREIGN PATENT DOCUMENTS

| | | | |
|---|---|---|---|
| 0004680 | 1/1977 | Japan | 248/328 |
| 7241 | 9/1893 | Switzerland | 248/328 |

*Primary Examiner*—Charles J. Myhre
*Assistant Examiner*—David A. Okonsky
*Attorney, Agent, or Firm*—James C. Wray

[57] ABSTRACT

One end of an elongated flexible strap is connected to a screw base. The strap extends downward through a central opening in a cover and in a reflector. After the screw base is threaded into a socket, a friction ring is pushed upward along the flexible strap, drawing the reflector up and a trim ring tight against the ceiling which surrounds the recessed fixture. The friction ring holds the lamp and reflector upward on the strap, without stretching the strap and without pulling downward on the screw base with a force substantially greater than a weight of the reflector and trim ring. While the friction ring holds the lamp on the strap, a gripper is moved into position beneath the friction ring to permanently support the friction ring. The strap is then clipped below the gripper.

18 Claims, 4 Drawing Figures

LAMP MOUNTING APPARATUS AND METHOD

BACKGROUND OF THE INVENTION

This is a continuation-in-part of application No. 645,288 filed Aug. 29, 1984.

Recessed ceiling lighting is a highly desirable light source. Usually a cylindrical fixture is mounted in the ceiling. A socket connected to an L-shaped bracket is vertically adjustable within the cylindrical fixture to hold the reflector lamp at the desirable height. Before inserting the reflector lamp in the cylindrical housing and screwing the lamp base into the socket, a trim ring or baffle is added to the housing by attaching springs to the baffle or trim ring at diametrically opposite positions, and stretching the springs upward and attaching them to openings in the sheet metal cylindrical housing. That is time consuming and difficult and requires expensive parts and substantial labor in assembly and installation operations.

When the socket is not adjustable, the reflector lamp may be positioned too deep within the cylindrical fixture or may extend downward from the cylindrical fixture. If the L-shaped bracket is bent, the lamp may be off center or crooked in the housing, resulting in an unsightly appearance and improper direction of the alumination. The L-shaped bracket may be slightly bent and misaligned by the weight of the lamp which tends to turn the bracket.

Heat buildup in previously existing lamps is a problem.

Prior lamps use only a portion of the ceiling opening to reflect light. Trim rings, which cover part of the opening, have been an added expense, and reduce the usable diameter of the opening.

Prior lamps using tubes have had difficulty in creating a point source effect. Circular tubes and linear tubes provide area sources which are difficult to focus and which cannot be properly used.

The incandescent lamps which may be 75, 100 or 150 watts consume a large amount of power. The lamps have relatively short lives, and frequent replacement of the expensive lamps adds to the cost of operating recessed ceiling lighting.

The present invention is designed to overcome the drawbacks of the prior art devices by providing self-trimming and self-aligning ceiling lamps which are quickly and easily installed.

SUMMARY OF THE INVENTION

A recessed lamp reflector has an integrally formed trim ring and fluorescent tube receptacles on opposite sides of an upper portion of the reflector. Fluorescent tubes extend across and downward, in the reflector, crossing at a central point within an upper portion of the reflector. Ballasts are mounted on an upper surface of the reflector between lamp receptacles. A cover covers the ballast and receptacles and interconnections and rests on top of the reflector. One end of an elongated flexible strap is connected to a screw base. The strap extends downward through a central opening in the cover and in the reflector. After the screw base is threaded into a socket, a friction ring is plushed upward along the flexible strap, drawing the reflector and trim ring tight against the ceiling which surrounds the recessed fixture. A force limiting means is interposed between the reflector means and the gripper means for limiting the force.

The recessed ceiling lighting apparatus of the present invention fits within an opening in a surface, particularly, for example, in a ceiling of a room. Preferably, although not necessarily, a sheet metal container, usually in a cylindrical shape but in any appropriate shape is positioned behind the opening in the surface. An electrical connector, for example a threaded socket or a bayonet or pin-type connector or a quick coupling connector or any other type of connector is positioned beyond the surface in such a manner that it is accessible through the opening. If the connector is a threaded socket, usually the connector is substantially centered beyond the opening. The present invention has electrically connected to the electrical connector a lamp which is mounted inside a reflector. The reflector of the present invention preferably has the general shape of a parabola with a circular lower opening and an upward and inward curved sidewall which terminates in a rounded upper end. The reflector may be of any suitable size and shape, for example, the reflector may be truncated, conical, rectangular, square or any convenient shape. In a preferred embodiment, a lamp receptacle which may be any convenient receptacle for receiving and holding the lamp is mounted externally of the reflector. The receptacle may be mounted in any convenient way such as directly on the reflector or on a device adjacent the reflector in such a way that the receptacle is connected to the reflector so that the lamp may be connected to the receptacle in such a way that the lamp is positioned within the reflector. In a preferred embodiment, the lamp is a high-output, low-wattage, long-life fluorescent lamp which extends across and slightly downward in the receptacle so that the light source is substantially centered in the reflector.

When two lamps are used the receptacles and lamps are slightly offset so that the lamps must closely approach each other at an upper and central position in the reflector. The lamps may be replaced with other light sources, for example, fluorescent sources, incandescent sources or other sources.

The power supply may be electrical lines which are electrically connected to the lamp receptacles or step-up or step-down, fixed or variable transformers or reactances. Preferably, the power supplies are ballasts which control initiation and maintenance of the glow discharge ionization in the tubular light sources. The ballasts or other power supply devices may be mounted in a convenient way. Preferably the ballasts are mounted on or adjacent the reflector in such a way that they may be connected to the reflector and to the lamp receptacles. When the ballasts are mounted on reflectors it is preferrable to mount one ballast directly opposite one lamp receptacle or to mount two ballasts and lamp receptacles in generally rectangular relationship. The electrical connector may be connected directly to the reflector. The power supply and receptacles may be left uncovered. Preferably, a cover surrounds the power supply and receptacles, which may be mounted on the cover. In a preferred embodiment, the cover is held between the electrical connector and the reflector by fasteners.

Connection means connects the electrical connector to the reflector and preferably to the cover. In one embodiment the connection means are fasteners which extend through aligned openings in the electrical connector, the cover and the reflector. The fasteners may be any convenient type of fasteners, for example, bolts and nuts or riveted fasteners.

In a preferred form of the invention, an elongated fastener means has a distal end of the fastener means connected to a remote portion of the light fixture or to any fixed position beyond the surface through which the lamp apparatus is mounted. The elongated connection means passes through one or more openings in the reflector and the cover if a cover is used. Sliding a friction ring upward on the connection means, pulls the reflector upward until the trim ring rests against the surface surrounding the opening through which the lamp apparatus is mounted. The friction ring holds the elongated connection means with a force which is sufficient to support the light fixture on the elongated connection means. Any excess upward force causes the friction ring to slide downward, relieving excess stress from the elongated connection means and its support. A gripper is slid upward beneath the friction ring. The elongated connection means may be severed below the gripper, and the connection means may remain within the reflector. In a preferred form of the invention, the connector means is flexible and is connected to the threaded base where it is fixed by the socket. When the friction ring is pushed upward towards the receptacle, any overtravel which adds stress on the socket and on its mount results in limited resilient pulling of the trim ring against the surface, which is desirable.

Recessed ceiling lighting apparatus has an electrical connector means for connecting to an electrical outlet, reflector means connected to the electrical connector for reflecting light generated by the lighting apparatus, lamp receptacle means connected to the reflector means for holding lamp means, and power supplying means connected to the lamp receptacle means and to the electrical connector means for supplying power from the electrical connector means to the lamp receptacle means. Lamp means is connected to the lamp receptacle means for providing lighting within the reflector. Connection means connected to the electrical connector means and to the reflector means holds the reflector means upward with the electrical connector means.

Trim ring means integrally connected to the reflector means extends outward therefrom.

Preferably the trim ring means is integrally formed with the reflector means and extends outward from a lower edge of the reflector means.

Preferably the reflector means has a relatively small upper end and a relatively larger lower end, and the receptacle means is mounted on the smaller upper end of the reflector means.

In a preferred embodiment, the receptacle means is mounted on an outer wall of the lamp means, and the receptacle means has cavity means opening inward in the receptacle means. The lamp means are fluorescent tube lamp means having base means for connecting with the cavity means. The fluorescent tube lamp means extends downward and across the reflector means.

Preferably the lamp means comprise first and second fluorescent lamps which extend across and downward from the receptacle means at slight angles to each other wherein the lamp means cross at a central position within an upper portion of the reflector means.

In the preferred embodiment the power supplying means are ballast means mounted on an upper portion of the reflector means.

Preferably the power supply means are first and second ballast means rectilinearly arranged with first and second receptacle means on an upper outer portion of the reflector means.

Cover means covering the power supplying means and the receptacle means are positioned between an upper portion of the reflector means and the electrical connector means.

Preferably the connection means are fastener means connected to the electrical connector means and to the reflector means for entrapping the cover means therebetween and for holding the reflector means upward toward the electrical connector means. Fastener means connect the cover means to the reflector means.

In a preferred embodiment the connection means comprises elongated means connected to the electrical connector means and extending downward through opening means in the reflector means. Friction means connect to the elongated means and slide along the elongated means in an upward direction toward the electrical connector means for gripping the elongated means and pulling the reflector means upward toward the electrical connector means as the friction means is slid upward along the elongated means.

Preferably the friction means grips the elongated means with a force sufficient to support the lighting apparatus on the elongated means. The ring may have a round, square, or polygonal or open cross-section.

Preferably the elongated means comprises single elongated means, and the opening means comprises a central opening in an upper end of the reflector means for slidingly receiving the elongated means and for permitting the elongated means to extend downward through the reflector means.

Preferably the elongated means has an enlarged upper end which is anchored in the electrical connector means.

In a preferred embodiment the elongated means is a flexible means.

The flexible means is a flexible strap means with rigid transverse stops which prevent downward sliding of the gripper means.

In a preferred lamp mounting apparatus embodiment, an elongated connection means has distal and proximal ends, means for connecting the distal end to a lamp fixture, means for permitting the sliding of the elongated connection means through a lamp apparatus, and gripper means connected to the elongated connection means for sliding along the elongated connection means and pulling the lamp apparatus towards the distal end of the elongated connection means.

Preferably the elongated connection means is a flexible strap having transverse stops for permitting sliding of the gripper means towards the proximal end of the elongated connection means and for preventing movement of the gripper means toward the proximal end of the elongated connection means.

Preferably the distal end of the elongated connection means is connected to a screw base for screwing into a socket in a light fixture.

In a preferred embodiment the gripper means has a toothed means for engaging stops on the elongated means and for permitting movement in an upward direction while preventing downward movement. Preferably the gripper means has releasing means for disengaging the toothed means from the stops on the elongated means thereby permitting downward movement.

A preferred mounting apparatus comprises an elongated flexible connection means having distal and proximal ends and having an enlarged portion at the distal end for connecting to a fixed object. The connection means has transverse stops across a body of the connection means between the distal and proximal ends. A friction means slides along the connection means from near the proximal end toward the distal end, for pulling a device with the friction means along the flexible elongated connection means toward the proximal end and for holding a device with the friction means on the elongated connection means. A gripper may be slid up to the friction means to prevent reverse movement. A portion of the connection means between the gripper and the proximal end may be removed after the device has been slid along the flexible connection means to a desired position.

A preferred method of mounting a light apparatus in a recessed ceiling fixture comprises passing an elongated connection means through a reflector in the light apparatus, connecting a distal end of the elongated connection means to a remote position in the ceiling fixture, sliding a friction block along the elongated connection means toward the reflector and sliding the friction block and the reflector toward the distal end of the connection means until the reflector is in the desired position, securing the friction block with a gripper block and removing a proximal portion of the elongated connection means between the gripper block and a proximal end of the elongated connection means.

In a preferred embodiment, one connects the distal end of the elongated connection means to a screw base and connects the screw base to a socket remotely positioned within a ceiling fixture. Supporting the reflector on the friction block which is connected to the elongated connection means near a proximal end, one slides the friction block and reflector toward the ceiling fixture. The friction block is supported with a gripper block which is moved upward against the friction block.

Another preferred embodiment of the connector means, is a smooth strap, or wire, or cord, which may be plastic, or metal, or any suitable material. A gripper means, using the principle concept of the well-known Tinnerman fastener, or speed-nut may be used in this innovation.

Removing the reflector from the ceiling fixture requires releasing the gripper block, removing the screw base from the socket, and removing the proximal d of the connection means from the screw base, placing a second elongated connection means through an opening in the reflector and connecting a distal end of the connection means to the screw base before reconnecting the screw base to the socket and sliding a second gripper block along the second connection means toward the screw base.

In one preferred embodiment of the invention, the friction block has a downward extending collar which at least partially encircles the elongated connection means. The collar crashes when excessive upward force is applied to the gripper block, allowing the friction block to move downward on the connection means toward the gripper block and relieving excess stress.

These and other and further objects and features of the invention are apparent in the disclosure which includes the above and ongoing specification with the claims and the drawings.

DETAILED DESCRIPTION OF THE DRAWINGS

Representative embodiments of the invention are described with reference to the accompanying drawings.

Figure 4:
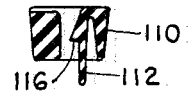
FIG. 4 is a cross-sectional detail of a preferred gripper.
Figure 3:
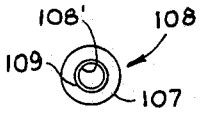
FIG. 3 is a bottom view of the friction-force limiting device.
Figure 2:
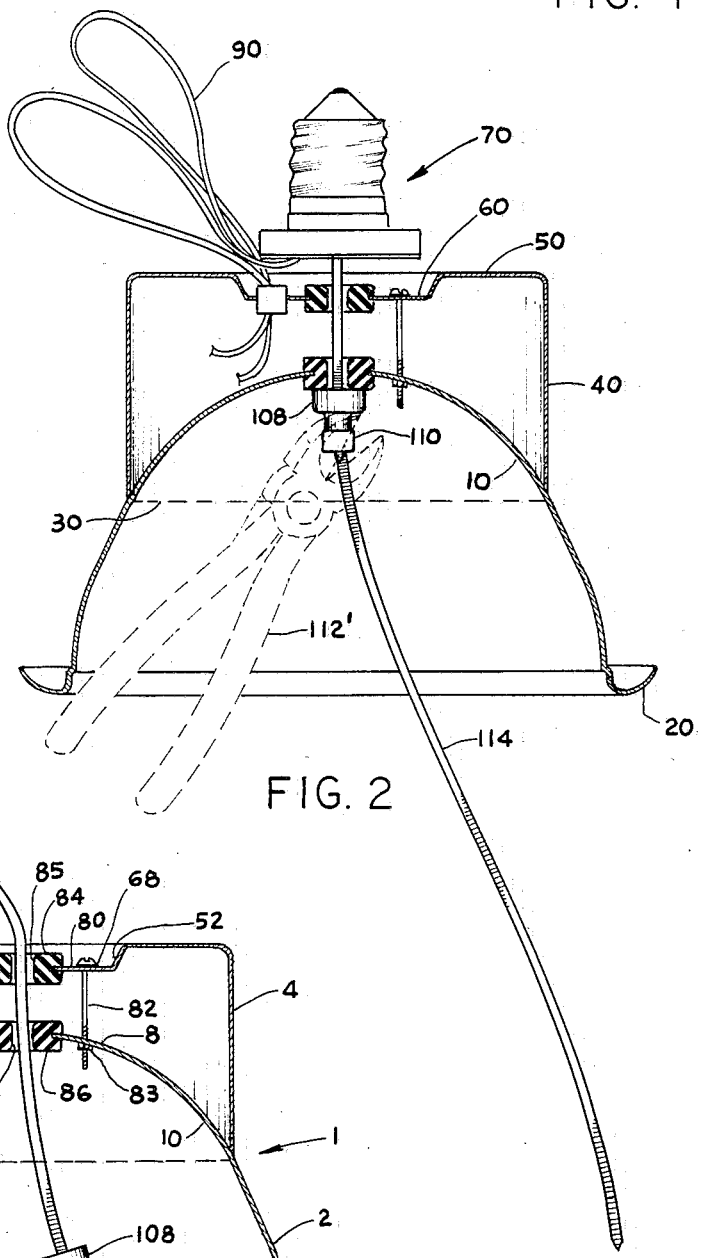
FIG. 2 is a elevation partially in cross section showing the lamp mounting apparatus with the lamp in an upward installed position.
Figure 1:
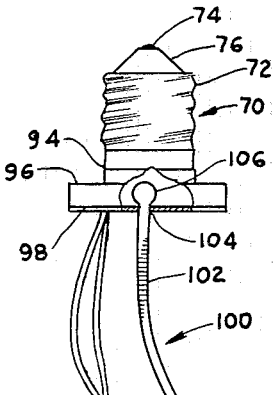
FIG. 1 is an elevational view partially in cross section showing a preferred lamp mounting apparatus and method.
Figure 1:
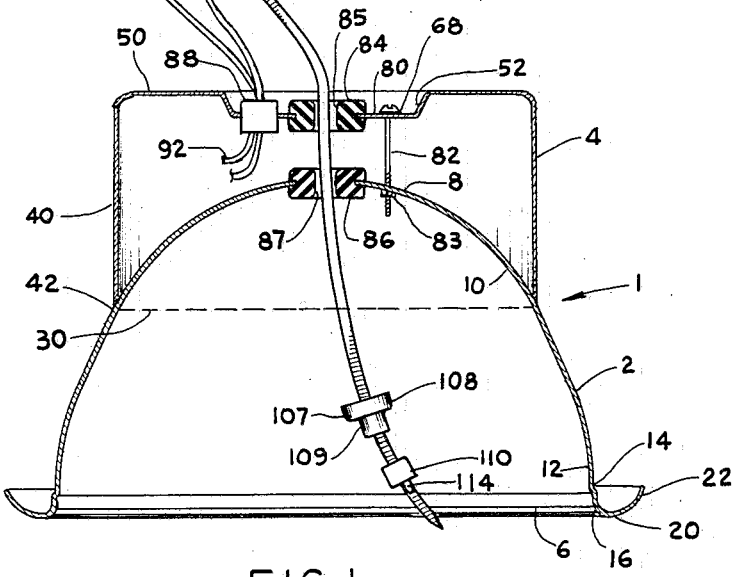

Referring to FIGS. 1 and 2, lamp 1 has a reflector 2, a cover 4 and a lens 6. A light source is mounted within the reflector 2 so that light shines through the lens 6.

In the case of preferred neon light sources, receptacles for neon tubes are mounted in an upper portion 8 of the reflector so that the receptacles open inward in the reflector to receive neon tubes pushed into the receptacles. One or more ballast is mounted on the upper side of the reflector beneath the cover 4. An upper part of the reflector 10 shines the light downward. The lower part 12 of the reflector fits within a recessed ceiling fitting. Shoulder 14 and detense at the area 16 hold lens 6. An integral trim ring 20 extends outward to an outer edge 22 which rests against a ceiling when the lamp apparatus 1 is pulled upward.

A fine shoulder or line 30 near the upper portion 10 of the reflector engages the lower edge 42 of the vertical wall 40 of the cover 4 to insure alignment of the cover 4 and reflector 2. An upper surface 50 of the cover may be generally flat. A sloping wall 52 leads downward to a recessed central portion 60 of the cover which has holes for bolts which hold the cover and reflector assembled and which has larger openings for bushings through which electrical wires and the main mounting strap pass.

A screw base 70 for screwing into an electrical receptacle within the recessed lighting fixture has an outer connector 72 and an inner connecter 74 separated by insulating material 76 as is conventional.

The preferred mounting means is shown in FIGS. 1 and 2. A central area 80 of the cover 4 and a central upper area of the reflector 2 are held together by bolts 82 and nuts 83, which may be two or three in number. A rubber bushing 84 is provided in the central opening of the cover 4 and the rubber bushing has a central opening 85. Rubber bushing 86 is provided in the central upper extremity of the reflector 2 and that rubber bushing has an axial opening 87 which is aligned with opening 85 in bushing 84. A bushing 88 in the flattened portion 80 of the cover 4 protects wires 90 against chafing. Ends 92 of the wires 90 are connected to the respective ballast and receptacles as shown in FIG. 2. Wire 90 has a sufficient length so that the wire is always loose and so that the reflector rests upon the connection means 100 even when the gripper 110 is in its lower position. Screw base 94 has a recessed base 96 with a plate 98 through which the connection means 100 and wires 90 pass.

The connection means 100 is constructed with a strap 102 with successive upward ramps and stops such as the straps in the double lock cable ties made by Ideal Industries of Sycamore, Ill. The strap passes through central openings 104 in the bottom plate 98 of the screw base. Above this, upper end 106 of the strap holds the distal ends of the strap in the screw base.

The strap passes through axial openings 85 and 87 in the bushings of the cover and reflector. Friction ring 108 loosely slides upward on the strap and draws the reflector to its upward position in which trim ring 20 contacts the ceiling. The friction ring limits the downward force on connection strap 102 and on screw base 70. Inner surface 108' grips and holds the smooth lateral faces of strap 102. Head 107 rests against bushing 86, and crushable collar 109 resists excessive force from gripper 110. Gripper 110 has an internal tooth which rides over the ramps in the up direction and grabs the stops in the down direction to permit upward movement of the gripper 110 on the strap and to prevent downward movement of gripper 110. Lever 112 may be moved outward to release tooth 116.

The screw base 94 is screwed into a socket in a recessed lighting fixture, and the lamp apparatus 1 is raised along the connection means to make sure that obstructions have been reduced and that the lamp apparatus fits within the recessed fixture. Once a correct fit has been assured, the lamp apparatus 1 may be lowered so that bushing 86 rests upon friction ring 108 against gripper 110. The proximal end of the strap beneath the friction ring 108 is grasped with one hand and friction ring 108 is pushed upward with the other hand raising the lamp apparatus 1 until it is in its upper most position with the trim ring resting against the surface in which the lamp apparatus is mounted. Releasing the friction ring and holding the strap one then slides gripper 110 upward until it just contacts collar 109.

A wire cutter 112' or scissors removes the lower portion 114 of the strap. A smooth rod or rods or straps may replace the straps and the gripper may be a fastener, speed nut or Tinnerman type fastener. The distal end may be fixed in any convenient way.

In the desired installation, one first turns off the power then remove the existing incandescent reflector lamp and then removes the spring mounted trim ring or baffle. Lamp centering tabs in the fixture are bent back into the fixture wall. If the lamp socket is on an adjustable bracket, a wing nut on the side of the fixture is loosened, the bracket is pushed to its maximum height, and the wing nut is tightened. The two lamps 70 are removed from the receptacles simply by pulling them in the direction of the lamp tubes. The light apparatus is picked up by the screw base with the strap and gripper supporting its weight, putting no strain on the wiring. The screw base is turned into in the fixture socket, while permitting the lamp apparatus to turn freely. Then the lamp apparatus is lifted into the ceiling recess and the trim ring is pushed against the ceiling to make sure that the apparatus fits. The lamp apparatus is lowered onto the gripper. Reaching inside the reflector, one grips the proximal end of the strap and pushes the gripper upward, lifting the lamp apparatus into the ceiling opening until the trim ring rests against the ceiling. The strap is cut beneath the gripper and installation is complete.

If the lamp apparatus needs to be lowered for any reason, such as for example, failure to bend centering tabs back into the fixture and to perform the initial insertion check, the gripper may be released by moving lever 112 so that the lamp apparatus may be removed. If the old strap is too short, removing two screws permits the removing of the base plate 98 from the screw base 94. The old strap is removed. A new strap is threaded through opening 104 in plate 98 and through openings 85 and 87 in bushings 84 and 86 and then a friction ring 108 and a gripper 110 is placed on the end of the strap before repeating the installation steps.

While a toothed strap is preferred, the advantages of the present invention may be realized by using a smooth strap and a gripper formed of sheet metal with a central "H" type cutout so that the inward legs formed by the H are deformed in a downward direction when the sheet metal gripper is pushed upward along the smooth strap. As a load is placed upon the sheet metal gripper which tends to move the gripper in a downward direction, the legs bite into the smooth strap preventing downward movement of the gripper and its load, which in this case is the lamp apparatus. The strap may be made of any suitable material. Preferably the material is able to withstand the modest heat within the lamp apparatus. Nylon material is suitable for many applications. Flexible straps having rectangular cross sections are preferred. Any angular cross section or curvilinear cross section may be employed.

I claim:

1. Lamp mounting apparatus comprising:

connection means having elongated means connected to a electrical connector means and extending downward through opening means in a reflector means, gripper means positioned downward of the reflector means being connected to the elongated means and slideable along the elongated means in an upward direction toward the electrical connector means for gripping the elongated means and force limiting means interposed between the reflector means and the gripper means for limiting any force exerted on the reflector means upward toward the electrical connector means as the gripper means is slid upward along the elongated means.

2. The apparatus of claim 1, wherein the elongated means comprises single elongated means and wherein the opening means comprises a central opening in an upper end of the reflector means for slidingly receiving the elongated means and for permitting the elongated means to extend downward through the reflector means.

3. The apparatus of claim 1, wherein the elongated means has an enlarged upper end which is anchored in the electrical connector means.

4. The apparatus of claim 1 wherein the force limiting means comprises means for at least partially surrounding the elongated connection means and having a crushable means extending along the elongated connection means.

5. The apparatus of claim 1, wherein the elongated means is a flexible means.

6. The apparatus of claim 5, wherein the flexible means is a flexible strap means with transverse stops which prevent downward sliding of the gripper means.

7. The apparatus of claim 1, wherein the force limiting means comprises a friction means for frictionally engaging the elongated connection means and permitting sliding in either direction when sliding force exceeds friction force.

8. The apparatus of claim 7, wherein the friction means comprises a ring surrounding the elongated means.

9. Lamp mounting apparatus comprising:

an elongated connection means having distal and proximal ends, means for connecting the distal end to a lamp fixture, means for permitting sliding of the elongated connection means through a lamp apparatus, and gripper means positioned downward of a reflector means of said lamp apparatus being connected to the elongated connection means for sliding along the elongated connection means and force limiting means interposed between the reflector means and the gripper means for limiting the force exerted on the lamp apparatus towards the distal end of the elongated connection means.

10. The apparatus of claim 9 wherein the elongated connection means is a flexible strap having transverse stops for permitting sliding of the gripper means towards the proximal end of the elongated connection means for preventing movement of the gripper means toward the proximal end of the elongated connection means.

11. The apparatus of claim 9, wherein the distal end of the elongated connection means is connected to a screw base for screwing into a socket in the light fixture.

12. Mounting apparatus comprising:

an elongated flexible connection means having distal and proximal ends and having an enlarged portion at the distal end for connecting to a fixed object, the connection means having transverse stops across a body of the connection means between the distal and proximal ends and a gripper means slidable along the connection means from near the proximal end toward the distal end, the gripper means and stops preventing movement of the gripper toward the proximal end of the connection means, force limiting means interposed between a reflector means of a movable lighting device and the gripper means for limiting the force exerted on the device with the gripper along the flexible elongated connection means toward the distal end and for holding the device with the force limiting means and the gripper on the elongated connection means, whereby a portion of the connection means between the gripper and the proximal end may be removed after the device has been slid along the flexible connection means to a desired position.

13. The apparatus of claim 12 wherein the force limiting means comprises a means for frictionally engaging the elongated connection means.

14. The apparatus of claim 12 wherein the force limiting means comprises distorting means extending along the connection means for distorting upon excessive force between the gripper means and the device.

15. A method of mounting a light apparatus in a recessed ceiling fixture comprising:

passing an elongated connection means through a reflector in the light apparatus, connecting a distal end of the elongated connection means to a remote position in the ceiling fixture, sliding a friction block from beneath the light apparatus along the elongated connection means toward the reflector and sliding the friction block and the reflector toward the distal end of the connection means until the reflector is in the desired position, sliding a gripper block beneath the friction block and removing a proximal portion of the elongated connection means between the gripper block and a proximal end of the elongated connection means.

16. The method of claim 15 further comprising:

connecting the distal end of the elongated connection means to a screw base and connecting the screw base to a socket remotely positioned within the ceiling fixture and supporting the reflector on the friction block which is connected to the elongated connection means near a proximal end thereof before sliding the friction block and reflector toward the ceiling fixture.

17. The method of claim 15 further comprising:

removing the reflector from the ceiling fixture by releasing the gripper block, removing the screw base from the socket, and removing the proximal end of the connection means from the screw base, placing a second elongated connection means through an opening in the reflector and connecting a distal end of the connection means to the screw base before reconnecting the screw base to the socket and sliding a second gripper block along the second connection means toward the screw base.

18. The method of claim 15 further comprising:

distorting a collar connected to the friction block upon excessive force.

* * * * *